US006271511B1

(12) United States Patent
Pierle

(10) Patent No.: US 6,271,511 B1
(45) Date of Patent: Aug. 7, 2001

(54) HIGH-RESOLUTION NIGHT VISION DEVICE WITH IMAGE INTENSIFIER TUBE, OPTIMIZED HIGH-RESOLUTION MCP, AND METHOD

(75) Inventor: Robert L. Pierle, Phoenix, AZ (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/253,335

(22) Filed: Feb. 22, 1999

(51) Int. Cl.[7] ..... H01J 40/14

(52) U.S. Cl. ..... 250/214 VT; 250/207; 313/103 CM

(58) Field of Search ..... 250/214 VT, 207; 313/103 CM, 105 CM

(56) References Cited

U.S. PATENT DOCUMENTS 3,660,668 5/1972 Wolski .
3,720,535 3/1973 Parish et al. .
3,742,224 6/1973 Einstein .
3,777,201 12/1973 Einstein .
5,756,989 * 5/1998 Bear et al. ..... 250/214 VT
5,866,901 * 2/1999 Penn et al. ..... 313/103 CM

* cited by examiner

*Primary Examiner*—F. L. Evans
(74) *Attorney, Agent, or Firm*—Marsteller & Associates, P.C.

(57) ABSTRACT

A night vision device (30) with an image intensifier tube (34) including an improved microchannel plate (42) which has a thickness no more than about 110% of the value indicated as optimum by the theoretical Universal Gain Curve. Accordingly, the microchannel plate (42) provides an improved resolution, and reduced operating voltage, and still provides a level of electron gain favorably comparable to conventional microchannel plates.

82 Claims, 4 Drawing Sheets

HIGH-RESOLUTION NIGHT VISION DEVICE WITH IMAGE INTENSIFIER TUBE, OPTIMIZED HIGH-RESOLUTION MCP, AND METHOD

BACKGROUND OF THE INVENTION

1. Field of the Invention

The present invention is generally in the field of night vision devices (NVD's) of the light-amplification type. Such NVD's employ an image intensifier tube ($I^2T$) to receive photons of light from a scene. This scene may be illuminated by full day light; or alternatively, the scene may be illuminated with light which is either of such a low level, or of such a long wavelength (i.e., infrared light), or both, that the scene is only dimly visible or is effectively invisible to the natural human vision. The $I^2T$ of such an NVD responsively provides a visible image replicating the scene. The present $I^2T$ has an optimized microchannel plate (MCP), which provides a combination of high resolution, efficiently achieved electron gain level, and lowed requirement for operating voltage. This combination was previously unobtainable in the art.

2. Related Technology

Even on a night which is too dark for natural human vision, invisible infrared light is richly provided in the near-infrared portion of the spectrum by the stars of the night sky. Human vision cannot utilize this infrared light from the stars because the infrared portion of the spectrum is invisible for humans. Under such conditions, a night vision device (NVD) of the light amplification type can provide a visible image replicating a night-time scene. Such NVD's generally include an objective lens which focuses light from the night-time scene through the transparent light-receiving face of an image intensifier tube ($I^2T$). At its opposite image-output face, the $I^2T$ provides a visible image, generally in yellow-green phosphorescent light. This image is then presented via an eyepiece lens to a user of the device.

A contemporary NVD will generally use an $I^2T$ with a photocathode (PC) behind the light-receiving face of the tube. The PC is responsive to photons of infrared light to liberate photoelectrons. Because an image of a night-time scene is focused on the PC, photoelectrons are liberated from the PC in a pattern which replicates the scene. These photoelectrons are moved by a prevailing electrostatic field to a microchannel plate (MCP) having a great multitude of microchannels, each of which is effectively a dynode. That is, these microchannels have an interior surface substantially defined by a material providing a high average emissivity of secondary electrons. In other words, each time an electron (whether a photoelectron or an electron previously emitted by the microchannel plate) collides with this material at the interior surface of the microchannels, more than one electron (i.e., secondary-emission electrons) leaves the site of the collision. This process of secondary electron emissions is not an absolute in each case, but is a statistical process having an average emissivity of greater than unity.

As a consequence, the photoelectrons entering the microchannels cause a cascade of secondary-emission electrons (which provide substantially a geometric multiplication in response to the photoelectrons) moving along the microchannels, from one face to the other of the MCP. The result is a spatial output pattern of electrons from the MCP (which replicates the input pattern; but at a very considerably higher electron density) issuing from the microchannel plate.

This pattern of electrons is moved from the microchannel plate to a phosphorescent screen electrode by another electrostatic field. When the electron shower from the photocathode impacts on and is absorbed by the phosphorescent screen electrode, a visible image is produced. This visible image is passed out of the tube through a transparent image-output window for viewing.

The necessary electrostatic fields for operation of an $I^2T$ are provided by an electronic power supply. Usually a battery provides the electrical power to operate this electronic power supply so that many of the conventional NVD's are portable. However, other sources of electrical power may be utilized to operate NVD's.

A goal that has long existed in the art of night vision devices is to improve the resolution provided by devices using $I^2T$'s. The resolution of NVD's using an $I^2T$ is essentially determined by the resolution of the tube itself, and this tube resolution is strongly influenced by the size and spacing dimension of the microchannels in the MCP of the $I^2T$. As a result, the art has sought over many years to progressively make both the size and the spacing dimension of the microchannels in MCP's of $I^2T$'s smaller and smaller. However, this effort has met with only limited success prior to this invention.

Several examples of contemporary MCP's (these being of 18 mm nominal diameter), their thickness, channel size, channel spacing dimension, open area ratio (OAR), and length-to-diameter (L/D) ratio may be seen in the following table.

TABLE 1

| | MCP Thickness | channel size | channel spacing | OAR | L/D ratio |
|---|---|---|---|---|---|
| Example 1 | 16.3 mil | 8.0 $\mu$ | 10.9 $\mu$ | 48.9% | 51.8:1 |
| Example 2 | 12.3 mil | 8.1 $\mu$ | 9.7 $\mu$ | 63.3% | 38.6:1 |
| Example 3 | 12.3 mil | 8.0 $\mu$ | 8.9 $\mu$ | 73.3% | 39.1:1 |
| Example 4 | 12.0 mil | 4.6 $\mu$ | 5.8 $\mu$ | 57.1% | 66.3:1 |
| Example 5 | 12.6 mil | 4.7 $\mu$ | 5.93 $\mu$ | 57.0% | 68.4:1 |
| Example 6 | 11.3 mil | 4.86 $\mu$ | 5.96 $\mu$ | 60.3% | 59.1:1 |
| Example 7 | 12.3 mil | 4.9 $\mu$ | 5.9 $\mu$ | 62.6% | 63.8:1 |

As can be readily seen from the above actual examples of the conventional art, conventional MCP's with relatively low resolution by current standards (i.e., with microchannels of about 8$\mu$size) may achieve a L/D (i.e., length-to-diameter) ratio for the microchannels of about 40 or a little less, with an OAR (open area ratio—expresses as a percentage) for the MCP of from the low 60's to the low 70's. However, such MCP's do not provide the image resolution desired for future NVD's. On the other hand, conventional MCP's with improved resolution (i.e., with microchannels of about 5$\mu$size) do not have quite as good of OAR, and have excessive L/D ratios (i.e., of about 60 or higher). The L/D ratio of a MCP is also an indication of the thickness of the MCP, since the microchannels extend from one face of the MCP to the other. It is also an indication, generally, of the required operating voltage for the MCP, since this voltage increases with increased thickness of the MCP.

Those ordinarily skilled in the art will understand that reductions in both microchannel size and microchannel spacing dimensions also have desirable and beneficial effects on other image quality factors. Two of these image quality factors that are favorably affected by reductions in microchannel size and spacing dimensions are known as fixed pattern noise and dark-multi-boundary noise. These image quality factors have to do with the "graininess" and mosaic effect visible in the image produced by an image intensifier tube.

A limiting problem with conventional $I^2T$'s is the desirable corresponding decrease in thickness of the MCP at the same time that the microchannels are made smaller. That is, the microchannels of a conventional MCP have a length (L) to diameter (D) ratio that conventionally falls within a selected range in order for the MCP to provide a desired level of electron gain. Because the differential voltage (i.e., the operating voltage) of an MCP depends in large part on its thickness, making MCP's thinner would have a beneficial effect because their required operating voltages would be lower. However, conventional MCP's cannot be made as thin as desired because if they are so thin, then they will not survive the conventional manufacturing processes, or will not have sufficient strength to survive common effects, such as: physical shocks, vibrations, handling, and thermal cycling, all of which they are necessarily subjected to in manufacturing and in use.

Accordingly, even those conventional MCP's, which presently have a microchannel size and spacing dimension that is larger than desired for better resolution, must still be made thicker than desired, and they also require a correspondingly higher operating voltage than is optimum. It follows that conventional NVD's using such MCP's must therefore have power supplies which supply operating voltages to the $I^2T$'s of these devices which are both higher than desired, and which are more expensive than is desired. Image intensifier tubes which are forced to operate at excessively high voltage levels across the MCP also suffer from reductions in manufacturing yield due to the possibility of internal arcing in the tubes, and with a reduction in image resolution because tube components have to be spaced further away from one another in order to minimize the possibility for this internal arcing. It will be understood by those ordinarily skilled in the pertinent arts that spacing of the MCP from other internal structures of an $I^2T$ (such as the PC and screen electrode) has a strong effect on image resolution, with reduced spacing being desired for improved resolution.

An additional understanding of this problem of excessive thickness and excessively high operating voltage for the MCP's of conventional image intensifier tubes may be achieved by consideration of the fact that the desired level of electron gain within an MCP (i.e., the ratio of electrons issuing from the MCP to photoelectrons received from the PC) is a function of the applied voltage level to the MCP. A conventional indication of the gain ratio for conventional MCP's is provided by a theoretical standard used for some years in the industry. This standard is generally referred to as the "Universal Gain Curve" (UGC), a commonly accepted example of which is set out herein as FIG. 4. This UGC suggests that as the size of the microchannels in a MCP is decreased, the thickness of the MCP should shrink correspondingly so that the MCP becomes thinner in order to operate with a particular level of electron gain. This relationship of the thickness of the MCP to the diameter of the microchannels is referred to as an L/D ratio (the same L/D ratio used in Table 1), where "L" is the length of the microchannels (i.e., substantially equal to the thickness of the MCP—allowing for some difference because of an intentional angulation of the microchannels relative to a perpendicular to the faces of the MCP), and "D" is the diameter of the microchannels. The theoretical operating voltage for an MCP depends according to the UGC upon the L/D ratio of the microchannels, and the resulting thickness of the MCP. But, until now thin, high-resolution, low-voltage MCP's have been merely theoretical because conventional technology cannot provide MCP's which have high resolution and meet the theoretical thickness and voltage criteria of the UGC.

The differential voltage required across a MCP in order to achieve the best theoretical electron gain is a function of the L/D ratio of the MCP. However, making a conventional MCP as thin as the UGC suggests for MCP's with small microchannels has never before been successful for several reasons. Principal among these reasons is a distortion (i.e., warping and curling) of the conventional MCP's under essential processing conditions (i.e., such as electron beam scrubbing, and hydrogen activation necessary, respectively, for the MCP to be sufficiently clean of indigenous gas molecules, and to be responsive to photoelectrons to release secondary-emission electrons).

Considering the materials from which conventional MCP's are made, those ordinarily skilled will know that a glass commonly used to make conventional MCP's is known as 8161, and is available commercially from Corning Glass Works. This 8161 glass is a high-lead glass that is also rather high in potassium oxide and sodium oxide. Conventional MCP's, when attempts are made to construct these MCP's according to the theoretical indications of the UGC, distort excessively during processing; and generally will not withstand the shock, vibration, handling, and thermal cycling requirements for a practical MCP. In some cases, attempts to make such a conventional MCP with a thickness approaching that suggested by the UGC have resulted in many of the MCP's simply falling apart (i.e., crumbling) merely as a result of the rigors of manufacturing. Even if they survived the rigors of the manufacturing process, such conventional MCP's would never be considered for use in an image intensifier tube or in a NVD because they are impossibly frail.

Moreover, and in contrast to a MCP embodying the present invention, conventional $I^2T$'s have not been able to utilize a MCP with a microchannel size and channel spacing as small at that achieved by the present invention, in combination with a MCP L/D ratio and plate thickness that is as thin as achieved by the present invention. Consequently, conventional MCP's have necessarily been made thicker than desired in order to survive the necessary processing steps, and have consequently required a higher than desired operating voltage to be applied to the MCP's. A MCP according to the present invention, in contrast, allows a considerably lower operating voltage.

Problems encountered with the conventional cladding glasses for MCP's (i.e., 8161 glass, and other conventional glasses as well) include, for example, excessive warping of MCP's during processing, an inability for the MCP work pieces to survive the necessary processing (i.e., sometimes even self-destruction because of the rigors of the manufacturing process itself), and an inability to survive necessary shock, vibration, handling, and thermal cycling requirements essential for manufacturing and use of $I^2T$'s and NVD's.

U.S. Pat. No. 3,720,535, issued Mar. 13, 1973; U.S. Pat. No. 3,742,224, issued Jun. 26, 1973; and U.S. Pat. No. 3,777,201, issued Dec. 4, 1973 provide examples of microchannel plates or image intensifier tubes having a microchannel plate.

An additional understanding of some of the limitations of conventional MCP's may be obtained now from a consideration of FIG. 5 (PRIOR ART). Viewing now FIG. 5, a conventional microchannel plate (MCP) 10 is depicted. Microchannel plate 10 includes a circumferential solid-glass rim portion 10*a*, and within this rim portion in an active area of the MCP, defines a plurality of angulated microchannels 12, which each open on the electron-receiving face 14 and on the opposite electron-discharge face 16 of the MCP 10. Microchannels 12 are separated by passage walls 18. The passage walls 18 each have a respective facial area when viewed in a direction perpendicular to the plane of FIG. 5, so that in facial view of the MCP 10 a web area (indicated by arrowed reference numeral 20) is cooperatively defined by these walls. Usually, the web area 20 of a MCP will be somewhat more or somewhat less than about 50% of the active area of the MCP 10 (recalling Table 1 above). It is to be understood that the MCP 10 has an inactive circumferential rim (not seen in the drawing Figures, but indicated by the arrowed numeral 10*a*) that provides for mounting and electrical connection to the MCP, but which rim portion does not include microchannels and is not active in the sense of providing secondary-emission electrons. At least a portion of the surface of the passage walls 18 bounding the channels 12 is defined by a material 18*a*, which is an emitter of secondary electrons.

Still viewing FIG. 5, it is seen that each face 14 and 16 of the MCP 10 carries a conductive electrode layer 22 and 24, respectively. These conductive electrode layers may be metallic, or may be formed of other conductive material so as to distribute an electrostatic charge over the respective faces of the microchannel plate 10. Importantly, the electrode layers 22 and 24 are utilized to apply a differential voltage across the MCP 10, as is indicated on FIG. 5 by the symbols V+, and V−, although it will be understood that these voltage indications are merely relative, and that neither voltage may actually be positive relative to ground.

For purposes of illustration and comparison, the microchannels 12 may have a diameter of approximately 5$\mu$-inch, on a spacing dimension of approximately 6$\mu$-inch, with a L/D ratio of about 60, and a MCP thickness of about 12 mils. This thickness is about 1.5 times the thickness for this MCP that would be indicated as optimum by the UGC. As a result, the MCP 10 must be operated with a differential voltage (i.e., V− to V+) of about 1100 to 1200 volts. This is an undesirably high operating voltage for the MCP 10. However, were the MCP manufactured according to the conventional teachings, and were it made with a thinner L/D ratio, then it is well understood in the art that this MCP would suffer from one or more of the deficiencies explained above. That is, the MCP 10 would undoubtedly suffer from warping and distortion during manufacturing, or would suffer from an inability to withstand shock, vibration, handling, and thermal cycling in use. With respect to the warping problem, it is generally known that with conventional glasses of the type that are traditionally used to make MCP's, if the L/D ratio is too thin then the active area of the MCP will shrink during manufacturing, drawing the rim portion 10*a* into a wavy or warped-disk shape. Thus, the conventional high-resolution MCP 10 (recalling examples 4–7 above) has heretofore always been made thicker than the desired L/D ratio so that the rim portion 10*a* will have sufficient strength to resist this warpage and provide a satisfactorily flat MCP.

Understandably, if in the interest of improving image resolution even more, a conventional type of MCP (like MCP 10) were made with even smaller microchannels than is indicated in the discussion above of FIG. 5, then the thickness "T" of this modified MCP would still need to be about the same (i.e., about 12 mils) in order for the rim portion of the modified MCP to be sufficiently strong to prevent warping of the MCP during manufacturing. Thus, it would be seen that the L/D ratio of this hypothetical "improved" MCP would be even higher (i.e., even higher than about 60), and the deviation of the "improved" MCP from the theoretical optimum operating voltage indicated by the UGC would be even greater. Thus, the quandary facing designers of MCP's at present is clearly presented. Further, the necessary operating voltage for the "improved" MCP would still be about the same as that required by MCP 10 because of the similar thickness for the "improved" MCP. A device using such a MCP probably would not benefit much, if at all, from the smaller size of the microchannels of such a MCP because of the internal component spacing necessitated by the required high MCP operating voltage.

SUMMARY OF THE INVENTION

In view of the deficiencies of the conventional related technology, it is desirable and is an object of this invention to provide a night vision device which overcomes or reduces the severity of at least one deficiency of the conventional technology.

Thus, it is desirable and is an object for this invention to provide an improved $I^2T$ having an improved resolution, an acceptable level of electron gain, and a lowered operating voltage requirement in comparison to conventional $I^2T$'s.

Still another object for this invention is to provide an $I^2T$ having a MCP with small microchannels and small microchannel spacing so that resolution is improved; with a L/D ratio that is approximately in accord with the UGC, so that an operating voltage requirement of the MCP to achieve an acceptable electron gain is lower than conventional MCP's; and with a correspondingly lowered operating voltage requirement for the MCP.

Further, it is desirable and is an object for this invention to provide an improved NVD utilizing such an $I^2T$.

More particularly, the present invention relates to an improved $I^2T$ having an improved microchannel plate (MCP) with a microchannel size of approximately 5$\mu$-inch, on a spacing dimension of approximately 6$\mu$-inch. The MCP is made with a L/D ratio approximating that indicated by the UGC (i.e., about 40), and thus is about 0.008 inches (i.e., 8 mils) thick. Yet despite this extreme thinness, the MCP survives conventional manufacturing processes, and survives manipulation and use stresses (i.e., shock, vibration, handling, and thermal cycling) required for manufacturing and use of $I^2T$'s. Further, the MCP according to the present invention does not warp or curl excessively during conventional manufacturing operations. Still further, because of its thinness a MCP embodying the present invention may be operated to provide a conventional level of electron gain while requiring about 200 to 300 volts less differential voltage across the MCP.

Most preferably, a MCP according to the present invention is fabricated using cladding glass for which the level of constituent potassium oxide and/or sodium oxide is particularly low. Particularly, while a convention MCP cladding glass most commonly has a level of potassium oxide of about 5% and a level of sodium oxide of about 0.34% (i.e., 8161 glass), a cladding glass preferred for use in the present MCP has essentially zero (i.e., no more than trace levels) of these two oxides.

The present invention according to one aspect provides a microchannel plate comprising a plate-like body formed substantially of glass and having a pair of opposite faces, the plate-like body including a solid-glass rim portion circumscribing an active area portion of the microchannel plate, and the active area defining a great multitude of fine-dimension microchannels each having a diameter (D) and a length (L) and extending through the plate-like body to open at respective opposite ends on the opposite faces, the microchannel plate active area portion having a thickness determined substantially by a L/D ratio of the microchannels, and the L/D ratio being no more than about 50.

According to another aspect, a method of making a microchannel plate as provided by the present invention includes steps of: providing a plate-like body formed substantially of glass; utilizing the plate-like body to define a pair of opposite faces, and providing the plate-like body with a rim portion circumscribing a perforate active area portion of the microchannel plate, forming in the active area portion a great multitude of fine-dimension microchannels each having a diameter (D) and a length (L) and extending through the plate-like body to open at respective opposite ends on the opposite faces; configuring the microchannel plate active area portion to have a thickness determined substantially by an L/D ratio of the microchannels; and providing for the L/D ratio to be no more than about 50.

Further, the present invention provides a method of making a microchannel plate including steps of: providing a plate-like body formed substantially of glass; utilizing the plate-like body to define a pair of opposite faces, and providing the plate-like body with a rim portion circumscribing a perforate active area portion of the microchannel plate, forming in the active area portion a great multitude of fine-dimension microchannels each having a diameter (D) and a length (L) and extending through the plate-like body to open at respective opposite ends on the opposite faces; hydrogen activating this plate-like body at elevated temperature to make the microchannel plate responsive to photons to release secondary electrons, and conducting said hydrogen activation at an elevated temperature in excess of about 500° C.

Advantages which derive from this invention include the provision of a NVD which may be less expensive because it requires a power supply circuit providing lower voltages to the $I^2T$. This NVD will provide improved resolution in comparison to conventional NVD's, and will also provide an image comparable in brightness to conventional NVD's because the MCP of the image intensifier tube is able to provide a conventional level of electron gain despite its operation at a voltage level that is considerably lower than required by conventional MCP's.

Other objects, features, and advantages of the present invention will be apparent to those skilled in the art from a consideration of the following detailed description of a preferred exemplary embodiment thereof taken in conjunction with the associated figures which will first be described briefly.

BRIEF DESCRIPTION OF THE DRAWING FIGURES

DETAILED DESCRIPTION OF AN EXEMPLARY PREFERRED EMBODIMENT OF THE INVENTION

While the present invention may be embodied in many different forms, disclosed herein is a specific exemplary embodiment that illustrates and explains the principles of the invention. It should be emphasized that the present invention is not limited to the specific embodiment illustrated and described.

Figure 1:
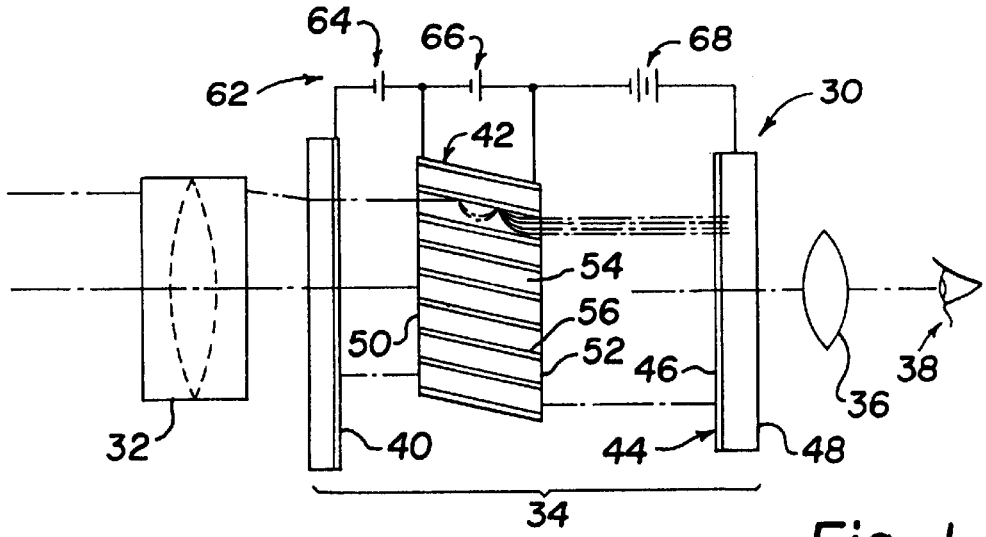
FIG. 1 is a schematic representation of a night vision device embodying the present invention.

Referring first to FIG. 1, there is shown schematically the basic elements of one version of a night vision device 30 of the light amplification type. Night vision device 30 generally comprises a forward objective optical lens assembly 32, which is illustrated by a single lens element on FIG. 1 (but, which is to be understood as possibly including one or more lens elements). This objective lens 32 focuses incoming light from a distant scene (which may be a day-time scene illuminated with fill day light, as will be explained, or may be a night-time scene illuminated with only dim star light or with infrared light from another source) through the front light-receiving end surface 34*a* of an image intensifier tube ($I^2T$) 34. As will be seen, this surface 34*a* is defined by a transparent window portion of the tube—to be further described below. As was generally explained above, the $I^2T$ provides an image at light output end 34*b* in phosphorescent yellow-green visible light, which image replicates the viewed or night-time scene.

Hereinafter, no distinction is maintained between the cases in which the scene is visible with natural vision to the user of the device, and the cases in which the scene is totally invisible to natural vision because it is illuminated only with star light or other infrared light. The device 30 can provide a visible image replicating the scene for the user under both of these extreme conditions, and at all illumination levels between these extremes. Again, a night time scene would generally be not visible (or would be only poorly visible) to a human's natural vision. The visible image from the $I^2T$ is presented by the device 30 to a user via an eye piece lens illustrated schematically as a single lens 36 producing a virtual image of the rear light-output end of the tube 34 at the user's eye 38.

Figure 2:
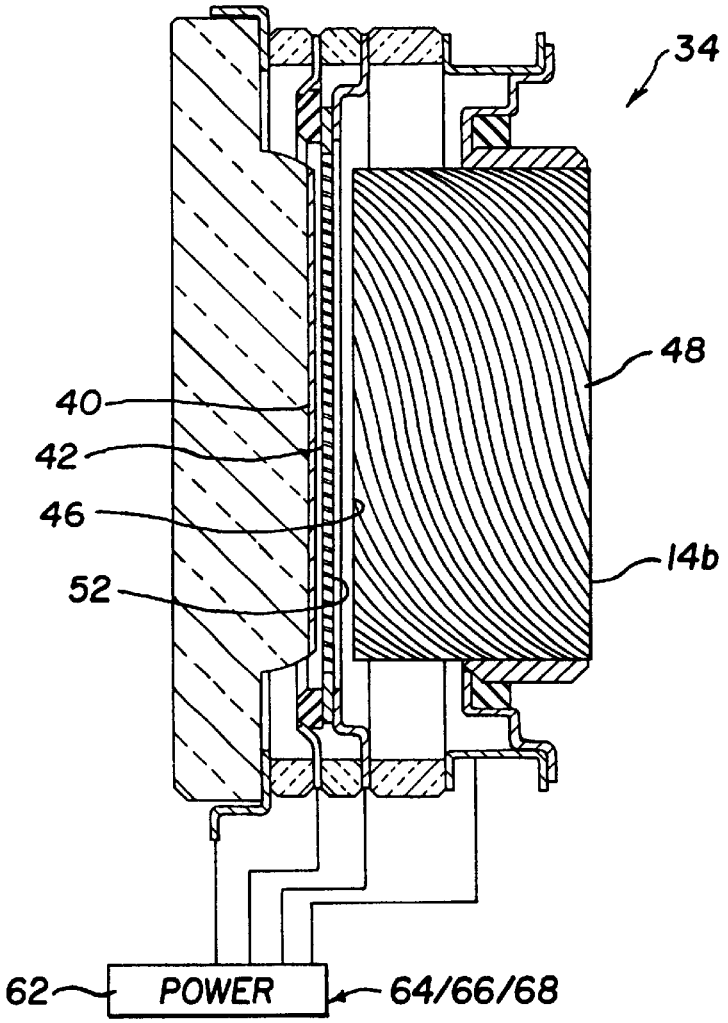
FIG. 2 shows an $I^2T$ in longitudinal cross section, with an associated power supply.

More particularly now viewing FIG. 2, it is seen that $I^2T$ 34 includes a photocathode (PC) 40 which is responsive to photons of infrared light to liberate photoelectrons, a microchannel plate (MCP) 42 which receives the photoelectrons in a pattern replicating the night-time scene, and which provides an amplified pattern of electrons also replicating this scene, and a display electrode assembly 44. In the present embodiment the display electrode assembly 44 may be considered as having an aluminized phosphor coating or phosphor screen 46. When this phosphor coating is impacted by the electron shower from microchannel plate 42, it produces a visible image replicating the pattern of the electron shower. Because the electron shower in pattern intensity still replicates the scene viewed via lens 32, a user of the device can effectively see in the dark, viewing a scene illuminated by only star light or other low-level or invisible infrared light.

A transparent window portion 48 of the $I^2T$ 34, to be further described below, conveys the image from screen 46 outwardly of the tube 34 so that it can be presented to the user 38. The window portion 48 may be plain glass, or may be fiber optic, as depicted in FIG. 2. Those ordinarily skilled will understand that a fiber optic output window portion 48 inverts the image provided by the screen 26 so that the user 38 is presented with an upright image.

Figure 3:
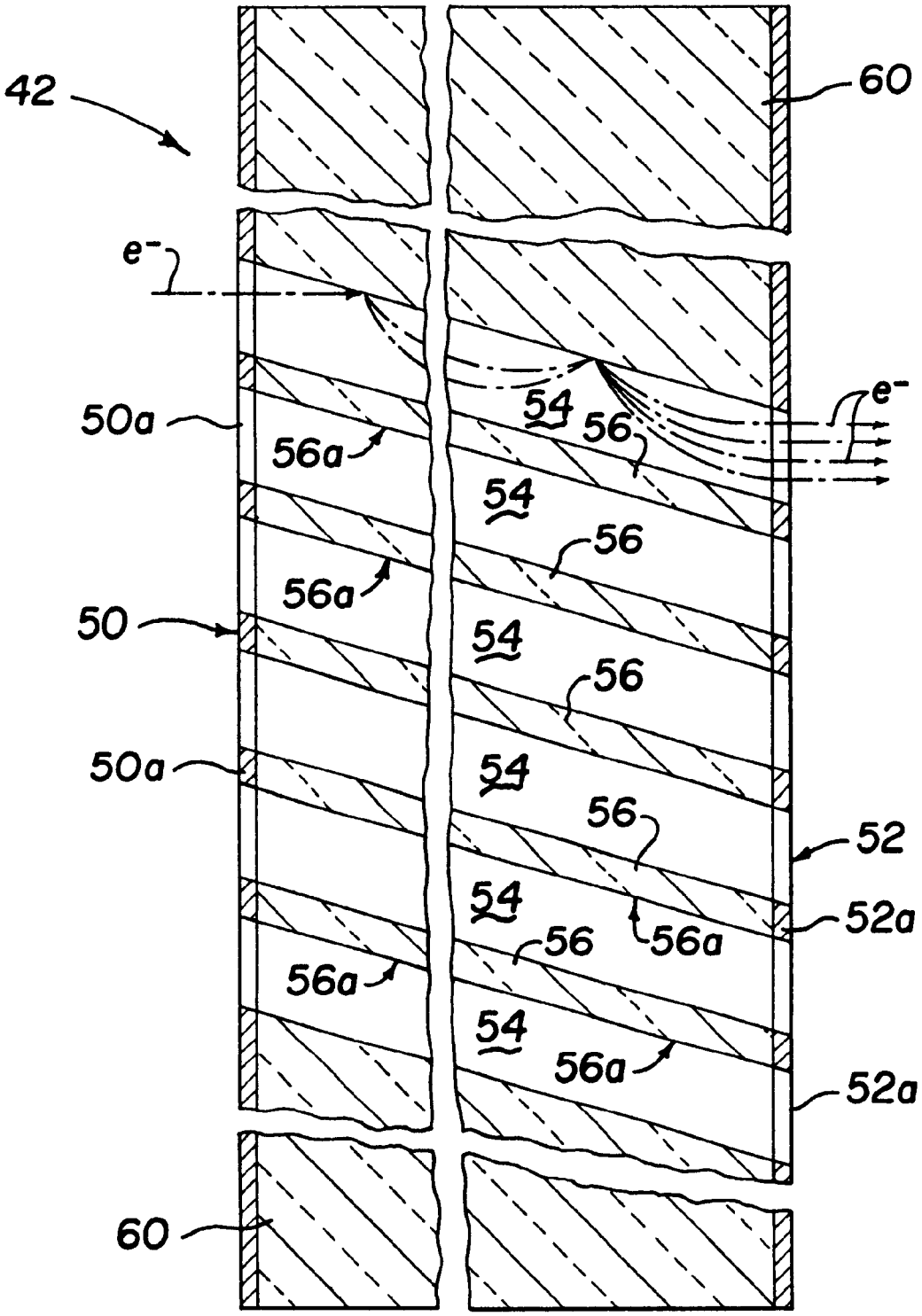
FIG. 3 is a greatly enlarged fragmentary cross sectional view of a microchannel plate of the $I^2T$ seen in FIG. 2.
Figure 4:
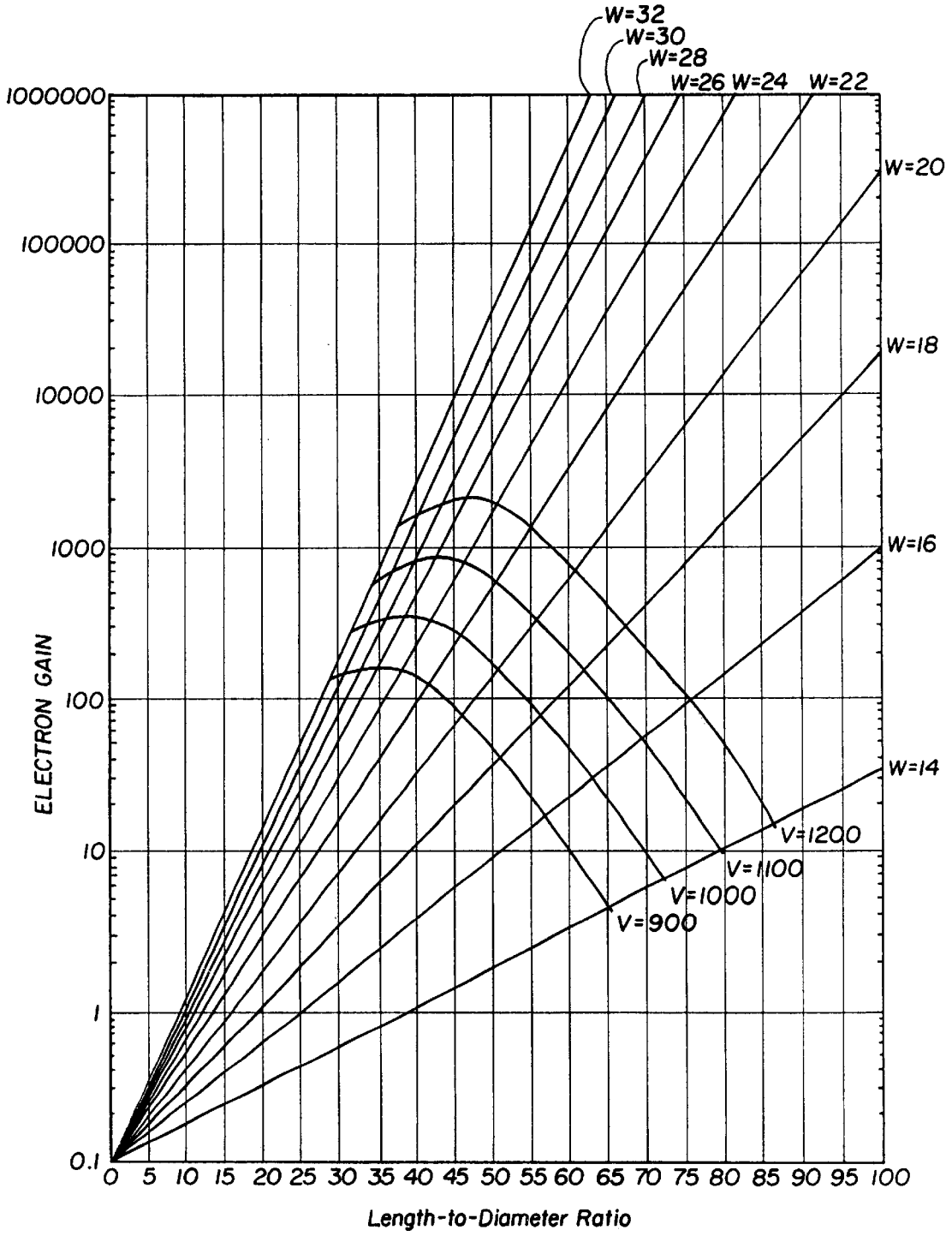
FIG. 4 is an example of the theoretical Universal Gain Curve for microchannel plates.

Still more particularly considering FIGS. 2 and 3, the MCP 42 is located just behind PC 40, with the MCP 42 having an electron-receiving face 50 and an opposite electron-discharge face 52. The microchannel plate 42 further defines a plurality of angulated microchannels 54 which open at respective opposite ends on each of the electron-receiving face 50 and on the opposite electron-discharge face 52. Microchannels 54 are separated by passage walls 56. The passage walls 56 each have a respective area when viewed facially in a direction perpendicular to the plane of FIG. 3, so that in facial view of the MCP 42 a web area (indicated by arrowed reference numeral 58) is cooperatively defined by these walls. Usually, the web area 58 of a MCP embodying the present invention will be somewhat less than 50% of the active area of the MCP (i.e., about half or less of the active area of the MCP 42 is defined by web area 58. It is to be understood that the MCP 42 has an inactive circumferential rim 60 (not seen in drawing FIG. 3, but indicated by arrowed numeral 60) that is the same thickness as the active portion of the MCP 42, and which provides for mounting and electrical connection to the MCP, but which rim portion does not include microchannels and is not active in the sense of providing secondary-emission electrons. At least a portion 56*a* of the surface of the passage walls 56 bounding the channels 54 is defined by a material which is an emitter of secondary electrons. Those ordinarily skilled will understand that this surface is defined by cladding glass used in the manufacturing of the MCP.

Still viewing FIGS. 2 and 3, it is seen that each face 50 and 52 of the MCP 42 carries a conductive electrode layer 50*a* and 52*a*, respectively. These conductive electrode layers may be metallic, or may be formed of other conductive material so as to distribute an electrostatic charge over the respective faces 50 and 52 of the microchannel plate 42. These electrode coatings do not span across the openings of the microchannels 54, and do not close the openings of these microchannels on the faces 50 and 52.

A power supply circuit 62 includes a power supply section, generally indicated with the numeral 64, which provides a differential voltage between the PC 40 and face 50 (i.e., electrode 50*a*) of the MCP 42. A power supply section 66 of circuit 62 similarly provides a differential voltage across the faces 50 and 52 (i.e., by application to the electrode layers 50*a* and 52*a*. Also, another power supply section 68 provides a voltage for propelling electrons from the MCP 42 to the display electrode assembly 44.

The focusing eye piece lens 36 is located behind the display electrode assembly 44 and allows an observer 38 to view a correctly oriented image corresponding to the initially received low-level image.

As will be appreciated by those skilled in the art and also viewing now particularly FIG. 2, the individual components of $I^2T$ 14 are all mounted and supported in a tube or chamber having forward and rear transparent plates cooperating to define a chamber which has been evacuated to a low pressure. This evacuation allows electrons liberated into the vacuum free-space within the tube to be transferred between the various components by prevailing electrostatic fields without atmospheric interference that could possibly decrease the signal-to-noise ratio. Because of the close proximity of the components of this type of image intensifier tube, it is referred to as a "proximity focused" type of tube.

Figure 5:
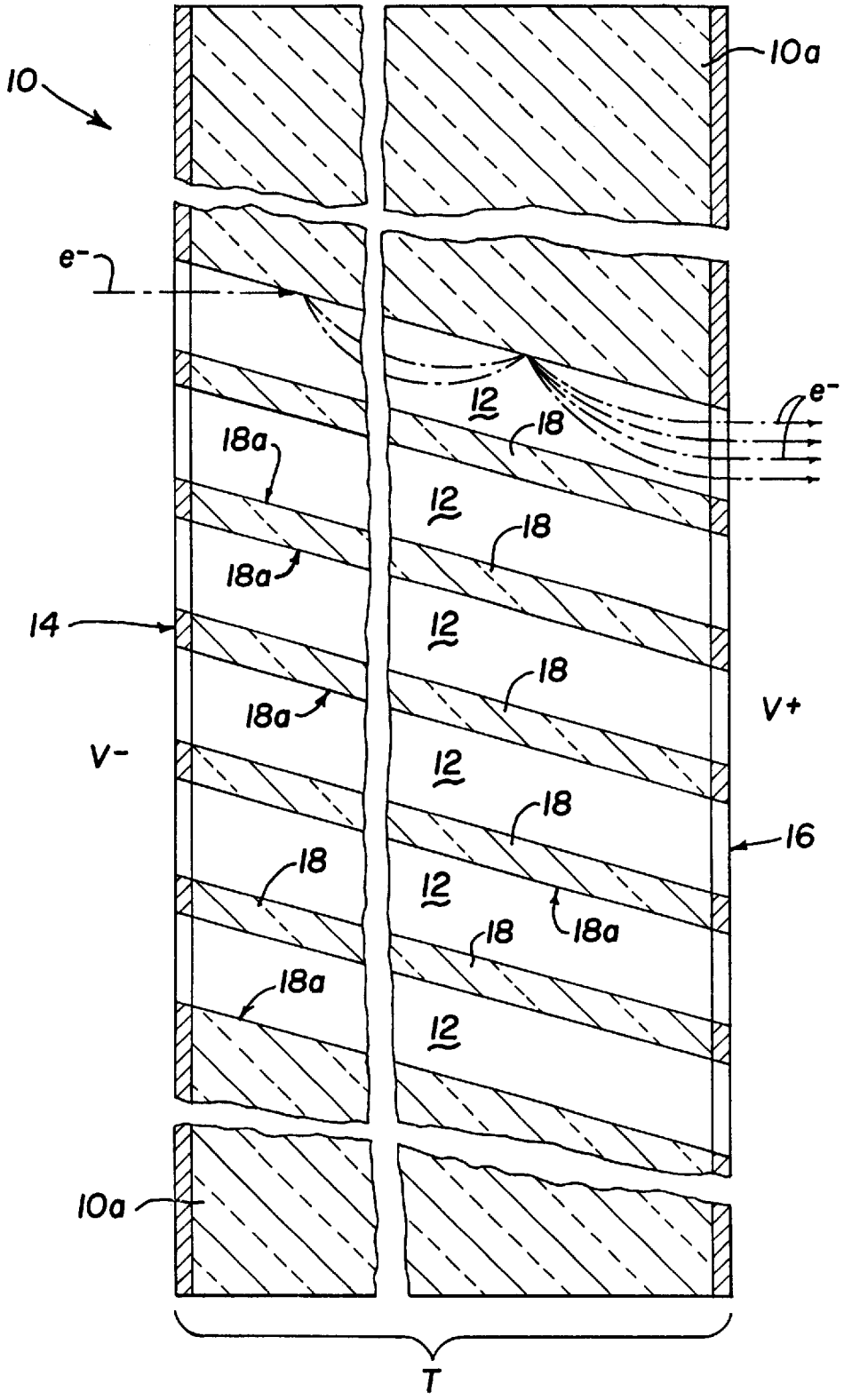
Fig. 5 (PRIOR ART)
FIG. 5 (PRIOR ART) is a greatly enlarged fragmentary cross sectional view of a conventional microchannel plate, and illustrates some of the ways in which this conventional microchannel plate differs from and falls short of desired characteristics.

Now particularly considering the MCP 42 as illustrated in FIG. 3, it is seen first of all that the microchannels 54 are of a smaller size than those of the conventional MCP seen in FIG. 5 (although these drawing Figures are not to scale, analogous features of these two Figures are drawn to a different size for convenient visual comparison). The MCP 42 is made with an active area of a cladding glass having a sufficiently high lead content that it is an acceptably active emitter of secondary electrons (i.e., after the MCP has been activated). However, its content of potassium oxide and/or sodium oxide is lower than the conventional glasses, such as 8161 glass, and its tendency to warp during manufacturing processes necessary to make the MCP 42 is much less than conventional glasses. To recap, an exemplary MCP 10 as seen in FIG. 5 (PRIOR ART) may be made with an active area of 8161 glass and have microchannels of 5$\mu$-inch diameter, on a spacing dimension of approximately 6$\mu$-inch. Further, this conventional MCP 10 will have an L/D ratio of approximately 60—primarily because the MCP would warp excessively during manufacturing if it were made thinner. Consequently, the MCP 10 will be about 12 mils thick, and will require a differential voltage across the MCP of about 1100–1200 volts in order to provide an acceptable level of electron multiplication in this MCP.

In contrast, the MCP 42 is most preferably made of glass that is low both in sodium and in potassium. Most preferably, the glass from which the active area of the MCP 42 is made is substantially free of both potassium and sodium (i.e., both in the elemental form and as oxides or other compounds). The MCP 42 has microchannels 54 of about 5$\mu$-inch diameter, on a spacing dimension of approximately 6$\mu$-inch. Thus, the MCP 42 will provide considerably better resolution than many conventional MCP's. Further, the MCP 42 is preferably made with a L/D ratio approximating that indicated to be optimum by the UGC (i.e., in the range of from about 38 to about 42), and thus is about 0.008 inches thick in this example. The L/D ratio of the MCP 42 is preferably about 40 or less (rather than substantially 60 as with the conventional MCP's), although this L/D ratio may fall in the range of about 50 to as little as about 30 for practical MCP's made according to the teachings of this invention.

As a result, this optimized MCP 42 may be operated with a voltage about 200–300 volts less than a conventional microchannel plate (i.e., with a voltage of about 900–1000 volts), and has essentially the same luminous gain as the conventional MCP in an image tube using a conventional MCP (i.e., about 50,000 luminous gain in an image intensifier tube using this MCP 42). Importantly, the MCP 42 has an L/D ratio that is no more than about 110% of the optimum L/D ratio indicated by the UGC for a MCP having the indicated microchannel size. Accordingly, the MCP 42 closely approximates the heretofore unobtainable theoretical performance of MCP's predicted by the UGC.

This combined level of performance, resolution, and low operating voltage for a MCP has not been previously achieved in a practical MCP suitable for serial production, the Applicant believes. Further, the operating voltage for the MCP 42 also approximates that predicted by the UGC (within about +20% of the predicted operating voltage), which allows a considerably lower operating voltage for an image intensifier tube 34 utilizing the MCP 42. This reduction in necessary operating voltages carries over to the power supply used in a NVD 30, and allows lower manufacturing costs, longer lived components, and a possibility of improved battery life for man-portable battery-powered NVD's.

The following tables provide first an example of the MCP 42 made in the 18 mm nominal size and according to the present invention, and a comparison of a preferred cladding glass for use in making the active area portion of this MCP set out in comparison to the formula for a conventional MCP cladding glass.

TABLE 2

| | MCP Thickness | channel size | channel spacing | OAR | L/D ratio |
|---|---|---|---|---|---|
| Example 1 | 8.0 mil | 4.86 $\mu$ | 5.96 $\mu$ | 60.3% | 41.8:1 |

TABLE 3

(approximate percentages)

| | Conventional 8161 cladding glass | Preferred cladding glass |
|---|---|---|
| SiO2 | 38% | 37% |
| B2O3 | 0% | 2.8% |
| Al2O3 | 0.24% | 1.35% |
| Cs2O | 0.29% | 4.12% |
| Rb2O | 3.7% | 0.85% |
| MgO | 0% | 0.85% |
| CaO | 0% | 2.25% |
| BaO | 2.05% | 19.7% |
| PbO | 50.5% | 26.6% |
| Bi2O3 | <0.04% | 2.48% |
| As2O3 | 0% | 0.65% |
| Sb2O3 | 0% | 0.28% |
| K2O | 5.44% | 0% (trace) |
| Na2O | 0.34% | 0% (trace) |
| Fe2O3 | 0.02% | 0% |

From the above table 3, it is seen that while potassium oxide is a significant constituent of the conventional 8161 glass, it is essentially absent from the preferred glass for use in making a MCP according to the present invention. The sodium oxide content of the conventional cladding glass is much less than the potassium oxide content, but is still significant. In contrast, the preferred cladding glass used in making a MCP according to the present invention is also substantially free of sodium. In both cases, substantially free means no more than trace amounts, and certainly less than one-half of one percent of the sodium oxide or potassium oxide. Further, the preferred cladding glass has about 26% lead oxide, which is about one-half of the level of lead oxide found in the conventional cladding glass. While the formula for this preferred cladding glass is set out above in some considerable detail and precision, it will be understood that variations in the formula of the cladding glass used to make a MCP according to this invention are permissible and are in fact within the ambit of this disclosure. Thus, the formula for preferred cladding glass set out above should be considered exemplary only, and is not limiting of the present invention.

Further, it will be appreciated by those ordinarily skilled in the pertinent arts that as part of the manufacturing process for making an MCP 42 embodying the present invention, an MCP work piece (which will become the MCP 42) is subjected to an activation process. Usually, this activation process involves exposure of the MCP work piece to high temperatures in an evacuated environment, and treatment of the MCP with activation elements, such as cesium and hydrogen. In particular, the hydrogen activation of MCP's is conducted at elevated temperatures in a hydrogen (i.e., reducing) atmosphere. In the case of conventional 8161 glass, this hydrogen activation will ordinarily be conducted at a temperature peaking at about 320° C. to about 360° C. Some conventional processes have attempted to use 8161 or other conventional glasses at hydrogen activation temperatures of up to about 480° C., although these MCP's and processes are believed to include other and undesirable compromises in the design of the MCP's, in the selection of glass chemistry employed, or both, so that the results have not been satisfactory or accepted in the art. In contrast, the present MCP 42 is hydrogen activated at a temperature preferably above about 500° C., or perhaps above about 550° C. Importantly, the hydrogen activation temperature for the MCP 42 is above the range of from about 500° C. to about 550° C. This hydrogen activation temperature range for the MCP 42 is well above that used successfully with 8161 or any other conventional glass to make a successful MCP. Thus, considering this hydrogen activation process in round numbers, the hydrogen activation temperature used for the MCP 42 is substantially 100° C. above that conventionally used to make other high resolution MCP's. But, it will be recalled further in view of the above, that these conventional high resolution MCP's are both thicker and require greater operating voltages than the MCP 42.

Moreover, a glass developed with the cooperation of personnel employed by the assignee of this invention, and which works successfully to make a MCP according to the present invention is available from Circon/ACMI. This exemplary glass is known as NV-30P cladding glass.

Those skilled in the art will appreciate that the embodiment of the present invention depicted and described herein and above is not exhaustive of the invention. Those skilled in the art will further appreciate that the present invention may be embodied in other specific forms without departing from the spirit or central attributes thereof. Because the foregoing description of the present invention discloses only an exemplary embodiment thereof, it is to be understood that other variations are recognized as being within the scope of the present invention. Accordingly, the present invention is not limited to the particular embodiment which has been described in detail herein. Rather, reference should be made to the appended claims to define the scope and content of the present invention.

I claim:

1. A microchannel plate comprising:

a plate body formed substantially of glass and having a pair of opposite faces, said plate body including a solid-glass rim portion circumscribing an active area portion of the microchannel plate, and said active area defining a great multitude of fine-dimension microchannels each having a diameter (D) and a length (L) and extending through said plate body to open at respective opposite ends on said opposite faces, said diameter (D) of said microchannels being less than 8$\mu$, said microchannel plate active area portion having a thickness determined substantially by a L/D ratio of said microchannels, said L/D ratio being no more than about 50, and said active area portion of said plate glass body is formed of glass having no more than about 30% lead oxide (PbO).

2. The microchannel plate of claim 1 wherein said active area portion of said plate body has a thickness of about 10 mils, and said L/D ratio is no more than about 42.

3. The microchannel plate of claim 1 wherein said microchannels each have a diameter of substantially 5$\mu$.

4. The microchannel plate of claim 1 wherein said multitude of microchannels are positioned on said plate body with a center to center distance of substantially 6$\mu$.

5. The microchannel plate of claim 1 wherein said active area portion of said plate glass body is formed of glass having about 25% to about 30% of lead oxide (PbO).

6. The microchannel plate of claim 1 wherein said active area portion of said plate glass body is formed of glass having about 20% barium oxide (BaO).

7. The microchannel plate of claim 1 wherein said active area portion of said plate glass body is formed of glass having substantially no more potassium than from a trace amount to about one-half of one percent.

8. The microchannel plate of claim 1 wherein said active area portion of said plate glass body is formed of glass having substantially no more sodium than from a trace amount to about one-half of one percent.

9. The microchannel plate of claim 1 wherein said L/D ratio is in the range from about 38 to about 42.

10. A method of making a microchannel plate comprising steps of:

providing a plate body formed substantially of glass;

utilizing said plate body to define a pair of opposite faces, and providing said plate body with a rim portion circumscribing a perforate active area portion of the microchannel plate forming in said active area portion a great multitude of fine-dimension microchannels each having a diameter (D) and a length (L) and extending through said plate body to open at respective opposite ends on said opposite faces;

configuring said microchannel plate active area portion to have a thickness determined substantially by an L/D ratio of said microchannels;

providing for said L/D ratio to be no more than about 50; and forming said active area portion of said plate body of glass having substantially no more potassium and substantially no more sodium than from a trace amount of each to one-half of one percent of each.

11. The method of claim 10 further including the step of providing for said plate body to have a thickness of no more than about 10 mils.

12. The method of claim 10 further including the step of providing for said microchannels to have a diameter of no more than about 5$\mu$.

13. The method of claim 10 further including the step of providing for said microchannels to be positioned on said plate body with a center to center distance of no more than about 6$\mu$.

14. The method of claim 10 further including the step of forming said active area portion of said plate glass body of glass having about 25% to about 35% lead oxide (PbO).

15. The method of claim 14 further including the step of forming said active area portion of said plate glass body of glass having no more than about 30% lead oxide (PbO).

16. The method of claim 10 further including the step of forming said active area portion of said plate glass body of glass having about 20% barium oxide (BaO).

17. The method of claim 10 further including the step of making said L/D ratio to have a value in the range from about 35 to about 42.

18. An image intensifier tube comprising:

a tube body having transparent front and rear plates;

a photocathode disposed behind said front plate and responsive to photons focused through said front plate to liberate photoelectrons in a pattern replicating said photons;

a microchannel plate disposed behind said photocathode to receive photoelectrons and responsively provide an amplified shower of secondary emission electrons in a pattern replicating said photoelectrons; said microchannel plate including a plate body formed substantially of glass and having a pair of opposite faces, an active area portion of the microchannel plate defining a great multitude of fine-dimension microchannels each having a diameter (D) and a length (L) and extending through said plate body to open at respective opposite ends on said opposite faces, said microchannel plate active area portion having a thickness determined substantially by a L/D ratio of said microchannels, said L/D ratio being no more than about 50, and said active area portion of said plate glass body is formed of glass having no more than about 30% lead oxide (PbO);

a screen electrode disposed behind said microchannel plate to receive said amplified shower of secondary emission electrons and to responsively liberate visible light.

19. The image intensifier tube of claim 18 wherein said active area portion of said plate body has a thickness of about 10 mils, and said L/D ratio is no more than about 42.

20. The image intensifier tube of claim 18 wherein said microchannels each have a diameter of substantially 5$\mu$.

21. The image intensifier tube of claim 18 wherein said microchannels are positioned on said plate body with a center to center distance of substantially 6$\mu$.

22. The image intensifier tube of claim 18 wherein said active area portion of said plate glass body is formed of glass having about 25% to 30% of lead oxide (PbO).

23. The image intensifier tube of claim 18 wherein said active area portion of said plate glass body is formed of glass having about 20% barium oxide (BaO).

24. The image intensifier tube of claim 18 wherein said active area portion of said plate glass body is formed of glass having substantially no more potassium and substantially no more sodium than from a trace amount of each to one-half of one percent of each.

25. A night vision device having an objective lens receiving light from a distant scene and focusing this light, an image intensifier tube having a tube body with a transparent front plate, a photocathode disposed behind said front plate and responsive to photons focused thereon liberate photoelectrons in a pattern replicating said scene; a microchannel plate disposed behind said photocathode to receive photoelectrons and responsively provide an amplified shower of secondary emission electrons in a pattern replicating said photoelectrons; said microchannel plate including a plate body formed substantially of glass and having a pair of opposite faces and having a diameter of at least 18 mm, said microchannel plate having an active area portion defining a great multitude of fine-dimension microchannels each extending through said plate body to open at respective opposite ends on said opposite faces, said microchannel plate active area portion having a thickness of no more than 10 mils; and said active area portion of said plate glass body is formed of glass having substantially no potassium and substantially no sodium.

26. The night vision device of claim 25 wherein said microchannels each have a length (L) and a diameter (D) cooperatively defining a L/D ratio, and said L/D ratio being no more than about 50.

27. The night vision device of claim 25 wherein said active area portion of said plate body has a thickness of about 10 mils, and said L/D ratio is no more than about 42.

28. The night vision device of claim 25 wherein said microchannels each have a diameter of substantially 5$\mu$.

29. The night vision device of claim 25 wherein said microchannels are positioned on said plate body with a center to center distance of substantially 6$\mu$.

30. The night vision device of claim 25 wherein said active area portion of said plate glass body is formed of glass having about 25% to 30% of lead oxide (PbO).

31. The night vision device of claim 25 wherein said active area portion of said plate glass body is formed of glass having no more than about 30% lead oxide (PbO).

32. The night vision device of claim 25 wherein said active area portion of said plate glass body is formed of glass having about 20% barium oxide (BaO).

33. A night vision device comprising: an objective lens receiving light from a scene being viewed and directing this light to an image intensifier tube, the image intensifier tube providing a visible image of the scene being viewed, and an eyepiece lens providing this visible image to a user of the night vision device; the image intensifier tube having a chambered evacuated housing, and including in the chamber of this housing a photocathode receiving photons from the scene and releasing photoelectrons in a pattern replicating the scene, a microchannel plate having microchannels opening in the direction of said photocathode to receive the photoelectrons and responsively providing a shower of secondary emission electrons in a pattern replicating the scene, and a screen receiving the shower of secondary emission electrons and producing a visible image replicating the scene, said microchannel plate having a great multitude of microchannels each of like diameter and having a length to diameter ratio in the range from about 38 to about 42, and said length to diameter ratio being no more than about 110% of the value indicated to be optimum by a universal gain curve.

34. A microchannel plate comprising: a circular plate body of at least 18 mm diameter, said body being formed substantially of glass and having a pair of opposite faces, said body including a rim portion circumscribing a central perforate active area-portion, and said active-area portion defining a great multitude of fine-dimension microchannels each having a diameter (D) and a length (L) cooperatively defining an L/D ratio, and said microchannels extending through said active-area portion to open at respective opposite ends on said opposite faces, said microchannel plate active-area portion having a thickness not exceeding about 10 mils, said L/D ratio being no more than about 50, and said glass being substantially free of potassium and substantially free of sodium.

35. A microchannel plate comprising: a plate body of glass having a circumferential rim and a central active area of perforate glass defining a multitude of fine-dimension microchannels each extending through said plate body to open on opposite faces thereof, said multitude of microchannels each being of diameter less than about 5$\mu$, and said multitude of microchannels being on a center-to-center spacing dimension of about 6$\mu$, said microchannels defining a length to diameter ratio of no more than about 40, and said microchannel plate carrying an electrode on each of said opposite faces across which is applied a differential voltage which does not exceed about 110% of the value indicated by the Universal Gain Curve for said microchannel plate.

36. A method of making a microchannel plate including steps of: providing a plate body formed substantially of glass; utilizing the plate body to define a pair of opposite faces, and providing the plate body with a rim portion circumscribing a perforate active area portion of the microchannel plate, forming in the active area portion a great multitude of fine-dimension microchannels each having a diameter and a length and extending through the plate body to open at respective opposite ends on the opposite faces; hydrogen activating this plate body at elevated temperature to make the microchannel plate responsive to photons so as to release secondary electrons, and conducting said hydrogen activation at an elevated temperature peaking in excess of about 500° C.

37. The method of claim 36 wherein said hydrogen activation step is conducted at an elevated temperature peaking in excess of about 550° C.

38. A method of making a microchannel plate including steps of:

providing a plate body formed substantially of glass defining a pair of opposite faces, a rim portion circumscribing a perforate active area portion of the microchannel plate, the active area defining a great multitude of fine-dimension microchannels each having a diameter and a length and opening at respective opposite ends on the opposite faces;

providing a pair of conductive electrodes each one of said pair of opposite faces;

hydrogen activating the plate body at elevated temperature to make the microchannel plate responsive to photons so as to release secondary electrons; and conducting said hydrogen activation at an elevated temperature peaking in excess of about 550° C.

39. The method of claim 38 further including the step of making said active area portion of said plate body to have a thickness of no more than about 10 mils.

40. The method of claim 38 further including the step of making said microchannels haven a length to diameter ratio of no more than about 42.

41. The method of claim 38 including the step of making said microchannels each have a diameter of substantially 5$\mu$.

42. The method of claim 38 further including the step of positioning said microchannels on said active portion of said plate body with a center to center distance of substantially 6$\mu$.

43. The method of claim 38 including the step of forming said active area portion of said plate glass body of glass having about 25% to 30% of lead oxide (PbO).

44. The method of claim 38 including the step of forming said active area portion of said plate glass body of glass having no more than about 30% lead oxide (PbO).

45. The method of claim 38 further including the step of forming said active area portion of said plate glass body of glass having about 20% barium oxide (BaO).

46. The method of claim 38 further including the step of forming said plate glass body of glass having substantially no more potassium and substantially no more sodium than from a trace amount of each to one-half of one percent of each.

47. A microchannel plate comprising:

a plate body formed substantially of glass and having a pair of opposite faces, said plate body including a solid-glass rim portion circumscribing an active area portion of the microchannel plate, and said active area defining a great multitude of fine-dimension microchannels each having a diameter (D) and a length (L) and extending through said plate body to open at respective opposite ends on said opposite faces, said diameter (D) of said microchannels being less than 8$\mu$, said microchannel plate active area portion having a thickness determined substantially by a L/D ratio of said microchannels, said L/D ratio being no more than about 50, and said active area portion of said plate glass body is formed of glass having about 20% barium oxide (BaO).

48. The microchannel plate of claim 47 wherein said active area portion of said plate body has a thickness of about 10 mils, and said L/D ratio is no more than about 42.

49. The microchannel plate of claim 47 wherein said microchannels each have a diameter of substantially 5$\mu$.

50. The microchannel plate of claim 47 wherein said multitude of microchannels are positioned on said plate body with a center to center distance of substantially 6$\mu$.

51. The microchannel plate of claim 47 wherein said active area portion of said plate glass body is formed of glass having about 25% to about 30% of lead oxide (PbO).

52. The microchannel plate of claim 47 wherein said L/D ratio is in the range from about 38 to about 42.

53. The microchannel plate of claim 47 wherein said active area portion of said plate glass body is formed of glass having substantially no more potassium than from a trace amount to about one-half of one percent.

54. The microchannel plate of claim 47 wherein said active area portion of said plate glass body is formed of glass having substantially no more sodium than from a trace amount to about one-half of one percent.

55. A microchannel plate comprising:

a plate body formed substantially of glass and having a pair of opposite faces, said plate body including a solid-glass rim portion circumscribing an active area portion of the microchannel plate, and said active area defining a great multitude of fine-dimension microchannels each having a diameter (D) and a length (L) and extending through said plate body to open at respective opposite ends on said opposite faces, said diameter (D) of said microchannels being less than 8$\mu$, said microchannel plate active area portion having a thickness determined substantially by a L/D ratio of said microchannels, said L/D ratio being no more than about 50, and said active area portion of said plate glass body is formed of glass having substantially no more potassium than from a trace amount to about one-half of one percent.

56. The microchannel plate of claim 55 wherein said active area portion of said plate body has a thickness of about 10 mils, and said L/D ratio is no more than about 42.

57. The microchannel plate of claim 55 wherein said microchannels each have a diameter of substantially 5$\mu$.

58. The microchannel plate of claim 55 wherein said multitude of microchannels are positioned on said plate body with a center to center distance of substantially 6$\mu$.

59. The microchannel plate of claim 55 wherein said active area portion of said plate glass body is formed of glass having about 25% to about 30% of lead oxide (PbO).

60. The microchannel plate of claim 55 wherein said L/D ratio is in the range from about 38 to about 42.

61. The microchannel plate of claim 55 wherein said active area portion of said plate glass body is formed of glass having about 20% barium oxide (BaO).

62. The microchannel plate of claim 55 wherein said active area portion of said plate glass body is formed of glass having substantially no more sodium than from a trace amount to about one-half of one percent.

63. A microchannel plate comprising:

a plate body formed substantially of glass and having a pair of opposite faces, said plate body including a solid-glass rim portion circumscribing an active area portion of the microchannel plate, and said active area defining a great multitude of fine-dimension microchannels each having a diameter (D) and a length (L) and extending through said plate body to open at respective opposite ends on said opposite faces, said diameter (D) of said microchannels being less than 8$\mu$, said microchannel plate active area portion having a thickness determined substantially by a L/D ratio of said microchannels, said L/D ratio being no more than about 50, and said active area portion of said plate glass body is formed of glass having substantially no more sodium than from a trace amount to about one-half of one percent.

64. The microchannel plate of claim 63 wherein said active area portion of said plate body has a thickness of about 10 mils, and said L/D ratio is no more than about 42.

65. The microchannel plate of claim 63 wherein said microchannels each have a diameter of substantially 5$\mu$.

66. The microchannel plate of claim 63 wherein said multitude of microchannels are positioned on said plate body with a center to center distance of substantially 6$\mu$.

67. The microchannel plate of claim 63 wherein said active area portion of said plate glass body is formed of glass having about 25% to about 30% of lead oxide (PbO).

68. The microchannel plate of claim 63 wherein said L/D ratio is in the range from about 38 to about 42.

69. The microchannel plate of claim 63 wherein said active area portion of said plate glass body is formed of glass having about 20% barium oxide (BaO).

70. The microchannel plate of claim 63 wherein said active area portion of said plate glass body is formed of glass having substantially no more potassium than from a trace amount to about one-half of one percent.

71. An image intensifier tube comprising:

a tube body having transparent front and rear plates;

a photocathode disposed behind said front plate and responsive to photons focused through said front plate to liberate photoelectrons in a pattern replicating said photons;

a microchannel plate disposed behind said photocathode to receive photoelectrons and responsively provide an amplified shower of secondary emission electrons in a pattern replicating said photoelectrons; said microchannel plate including a plate body formed substantially of glass and having a pair of opposite faces, an active area portion of the microchannel plate defining a great multitude of fine-dimension microchannels each having a diameter (D) and a length (L) and extending through said plate body to open at respective opposite ends on said opposite faces, said microchannel plate active area portion having a thickness determined substantially by a L/D ratio of said microchannels, said L/D ratio being no more than about 50, and said active area portion of said plate glass body is formed of glass having about 20% barium oxide (BaO);

a screen electrode disposed behind said microchannel plate to receive said amplified shower of secondary emission electrons and to responsively liberate visible light.

72. The image intensifier tube of claim 71 wherein said active area portion of said plate body has a thickness of about 10 mils, and said L/D ratio is no more than about 42.

73. The image intensifier tube of claim 71 wherein said microchannels each have a diameter of substantially 5$\mu$.

74. The image intensifier tube of claim 71 wherein said microchannels are positioned on said plate body with a center to center distance of substantially 6$\mu$.

75. The image intensifier tube of claim 71 wherein said active area portion of said plate glass body is formed of glass having about 25% to 30% of lead oxide (PbO).

76. The image intensifier tube of claim 71 wherein said active area portion of said plate glass body is formed of glass having substantially no more potassium and substantially no more sodium than from a trace amount of each to one-half of one percent of each.

77. An image intensifier tube comprising:

a tube body having transparent front and rear plates;

a photocathode disposed behind said front plate and responsive to photons focused through said front plate to liberate photoelectrons in a pattern replicating said photons;

a microchannel plate disposed behind said photocathode to receive photoelectrons and responsively provide an amplified shower of secondary emission electrons in a pattern replicating said photoelectrons; said microchannel plate including a plate body formed substantially of glass and having a pair of opposite faces, an active area portion of the microchannel plate defining a great multitude of fine-dimension microchannels each having a diameter (D) and a length (L) and extending through said plate body to open at respective opposite ends on said opposite faces, said microchannel plate active area portion having a thickness determined substantially by a L/D ratio of said microchannels, said L/D ratio being no more than about 50, and said active area portion of said plate glass body is formed of glass having substantially no more potassium and substantially no more sodium than from a trace amount of each to one-half of one percent of each;

a screen electrode disposed behind said microchannel plate to receive said amplified shower of secondary emission electrons and to responsively liberate visible light.

78. The image intensifier tube of claim 77 wherein said active area portion of said plate body has a thickness of about 10 mils, and said L/D ratio is no more than about 42.

79. The image intensifier tube of claim 77 wherein said microchannels each have a diameter of substantially $5\mu$.

80. The image intensifier tube of claim 77 wherein said microchannels are positioned on said plate body with a center to center distance of substantially $6\mu$.

81. The image intensifier tube of claim 77 wherein said active area portion of said plate glass body is formed of glass having about 25% to 30% of lead oxide (PbO).

82. The image intensifier tube of claim 77 wherein said active area portion of said plate glass body is formed of glass having about 20% barium oxide (BaO).

* * * * *